United States Patent [19]

Kohl

[11] 4,358,939

[45] Nov. 16, 1982

[54] RASCHEL WARP KNITTING MACHINE

[75] Inventor: Karl Kohl, Obertshausen, Fed. Rep. of Germany

[73] Assignee: Sulzer Brothers Limited, Winterthur, Switzerland

[21] Appl. No.: 157,055

[22] Filed: Jun. 6, 1980

[30] Foreign Application Priority Data

Jun. 15, 1979 [CH] Switzerland ..... 5613/79

[51] Int. Cl.[3] ..... D04B 23/00; D04B 27/00

[52] U.S. Cl. ..... 66/203; 66/109

[58] Field of Search ..... 66/84, 203, 204, 207, 66/109, 104

[56] References Cited

U.S. PATENT DOCUMENTS

| | | | |
|---|---|---|---|
| 2,699,658 | 1/1955 | Peters | 66/207 |
| 3,099,921 | 8/1963 | Liebrandt | 66/214 |
| 3,512,378 | 5/1970 | Bosse-Platiere | 66/84 |

*Primary Examiner*—Ronald Feldbaum

*Attorney, Agent, or Firm*—Kenyon & Kenyon

[57] ABSTRACT

The Raschel machine is provided with locking belts which are fixed relative to a plane perpendicular to the shogging motion. In addition, the yarn laying-in comb and at least one guide bar for the stitch yarns are movable not only in a plane perpendicular to the shogging direction but also in a plane parallel to the shogging direction. The motion of the laying-in comb allows large underlaps without risk of faulty lapping of the yarns.

4 Claims, 3 Drawing Figures

RASCHEL WARP KNITTING MACHINE

This invention relates to a warp knitting machine. More particularly, this invention relates to a Raschel warp knitting machine.

Heretofore, Raschel warp knitting machine have been known wherein a plurality of lapping belts for guiding pattern yarns are disposed for movement in a shogging direction while a yarn laying-in comb and a guide bar or guide belt for stitch yarns have been mounted for oscillating motion in a plane perpendicular to the planes of the lapping belts. In one known Raschel machine, for example as described in German Pat. No. 15 88 537, the length of the shogging motion of the lapping belts is limited. This is because, if the length is great, the pattern yarns are at a considerable inclination and frequently do not reach the required sinker lane. Thus, the shogging in these machines is usually not more than 8 to 10 needles in order to perform satisfactory work. Thus, these machines have a smaller range of variation in the pattern.

Accordingly, it is an object of the invention to produce a faultless cloth over a shogging length greater than 8 to 10 needles.

It is another object of the invention to provide a Raschel machine which has a relatively large range of pattern variation.

It is another object of the invention to provide for a wide range of variation in the pattern produced in a cloth on a Raschel machine.

Briefly, the invention is directed to a Raschel warp knitting machine which is comprised of a plurality of needles, a plurality parallel lapping belts for guiding pattern yarns to the needles, a means for selectively shogging the belts in a shogging direction parallel to the belts, a yarn laying-in comb mounted for orbital motion perpendicular to the shogging direction and a guide bar or guide belt for guiding stitch yarns to the needles also mounted for oscillation perpendicular to the shogging direction. In accordance with the invention, the Raschel machine is provided with a means for driving the comb for a uniform selectible shogging distance in the shogging direction. The amount of motion is herein termed "the fixed shogging length".

In addition, a second means is provided for driving the guide bar or guide belt for a uniform selectable distance in the shogging direction. This means may be driven along with the means for driving the comb in the shogging direction from a single shaft in synchronized relation.

If the fixed shogging length, for example as chosen by means of a suitable cam, over which the yarn laying-in comb is continuously and additionally moved in the shogging direction, one or more lapping belts first carry out part of their shogging motion according to their programmed pattern. Thereafter, the laying-in comb engages and immediately travel over the fixed shogging length. This is then added to the shogging of the lapping belts.

If the fixed shogging length is, for example 8 needles, while the lapping belts are shogged, for example up to 8 needles, the resulting underlapping is 16 needles. This is far above the previously obtainable value and is without the risk of faulty lapping.

If the pattern requires shogging by one or more lapping belts equal to the chosen fixed shogging length of the machine, the corresponding lapping belts will not shogg but will stay still. In this case, the underlapping of the pattern yarns will be brought about only by the laying-in comb in accordance with the fixed shogging length programmed for the comb.

If, on the other hand, pattern lapping has to occur over a shogging length shorter than the fixed length, the corresponding lapping belts are driven in the opposite direction to the fixed shogging length for a length which is correspondingly smaller than the fixed length.

If it is subsequently desired not to underlap one or more pattern lapping belts, the belts are driven in the opposite direction to the fixed shogging length for a distance equal to the fixed shogging length. Thus, the shogging of the laying-in comb and lapping belts cancel each other out so that there is no underlapping.

These and other objects and advantages of the invention will become more apparent from the following detailed description and appended claims taken in conjunction with the accompanying drawings in which:

and

Figure 3:
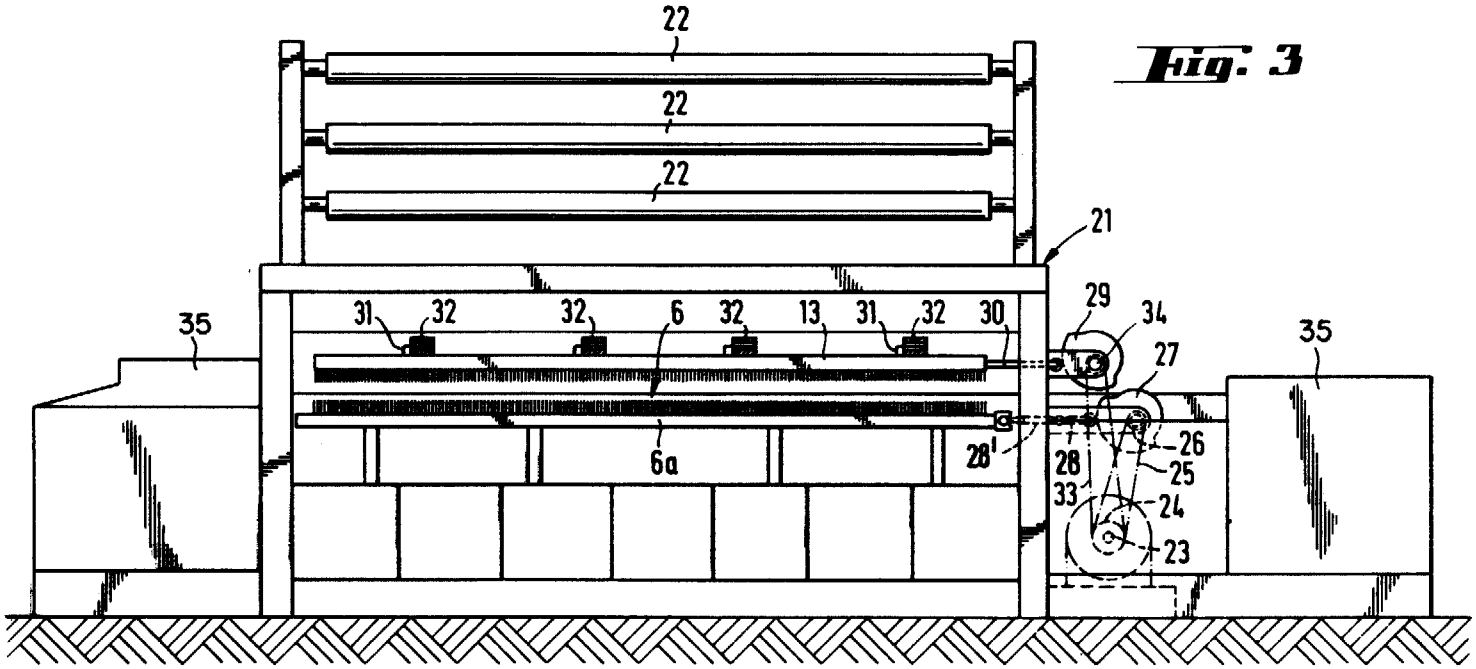

FIG. 3 illustrates a view perpendicular to the longitudinal axis of the Raschel machine of the means for moving the laying-in comb and guide bar during shogging in accordance with the invention.

Figure 1:
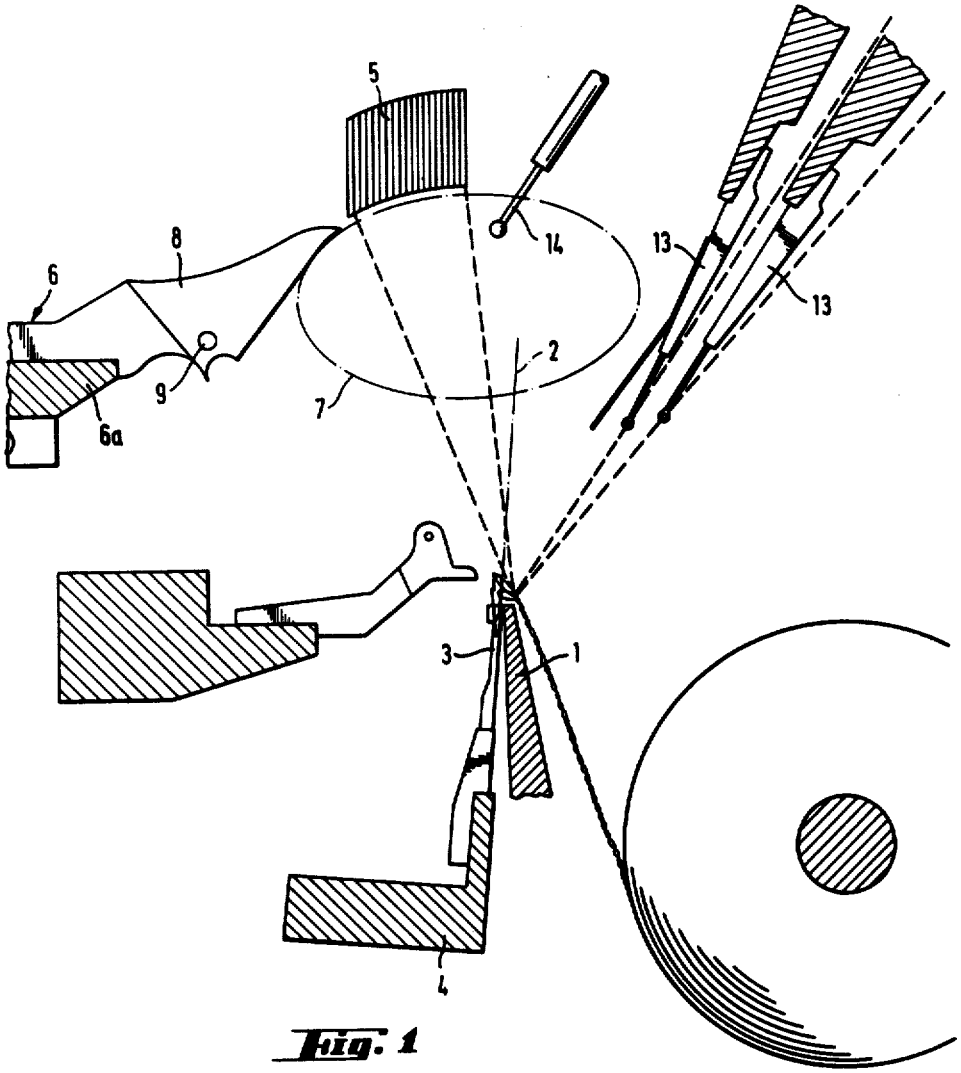
FIG. 1 illustrates a side view of a part of a Raschel machine constructed in accordance with the invention.

Referring to FIG. 1, the Raschel machine is constructed with a comb plate 1 for guiding a plurality of Raschel needles 3 in a plane 2 coincident with the axes of the needles 3. As indicated, the needles 3 are disposed in a bar 4 which reciprocates in an up and down manner. In addition, a plurality of parallel lapping belts 5 are disposed above the comb 1 for guiding pattern yarns to the needles 3. The belts are mounted for shogging in a shogging direction parallel to the belts 5 and are disposed in closely adjacent relation to cooperate with a yarn laying-in comb 6.

The yarn laying-in comb 6 is mounted on a bar 6*a* and is formed of a plurality of sinkers 8 each of which carries a guide rod 9 for cooperating with the pattern yarns. As indicated, the comb 6 is mounted for orbital motion in the path defined by the chain-dotted line 7 perpendicular to the shogging direction of the lapping belts 5.

In addition, the comb 6 is mounted via the bar 6*a* for motion parallel to the shogging direction, Thus, the comb 6 moves in the path 7 along with a superposed shogging motion. The comb 6 thus moves in addition at an angle to the plane of the drawing.

In addition, guide bars 13 having needle guides are provided on the side of the plane 2 opposite from the belts 5 and comb 6 for guiding stitch yarns to the needles 3. These guide bars are mounted not only for oscillation perpendicular to the shogging direction but also for a shogging motion in the shogging direction. Thus, the guide bars 13 also oscillate together with a superposed motion at an angle to the plane of the drawing.

Sitll further, a guide rod 14 for deflecting the pattern yarns is coupled to the guide bars 13 for simultaneous motion.

Figure 2:
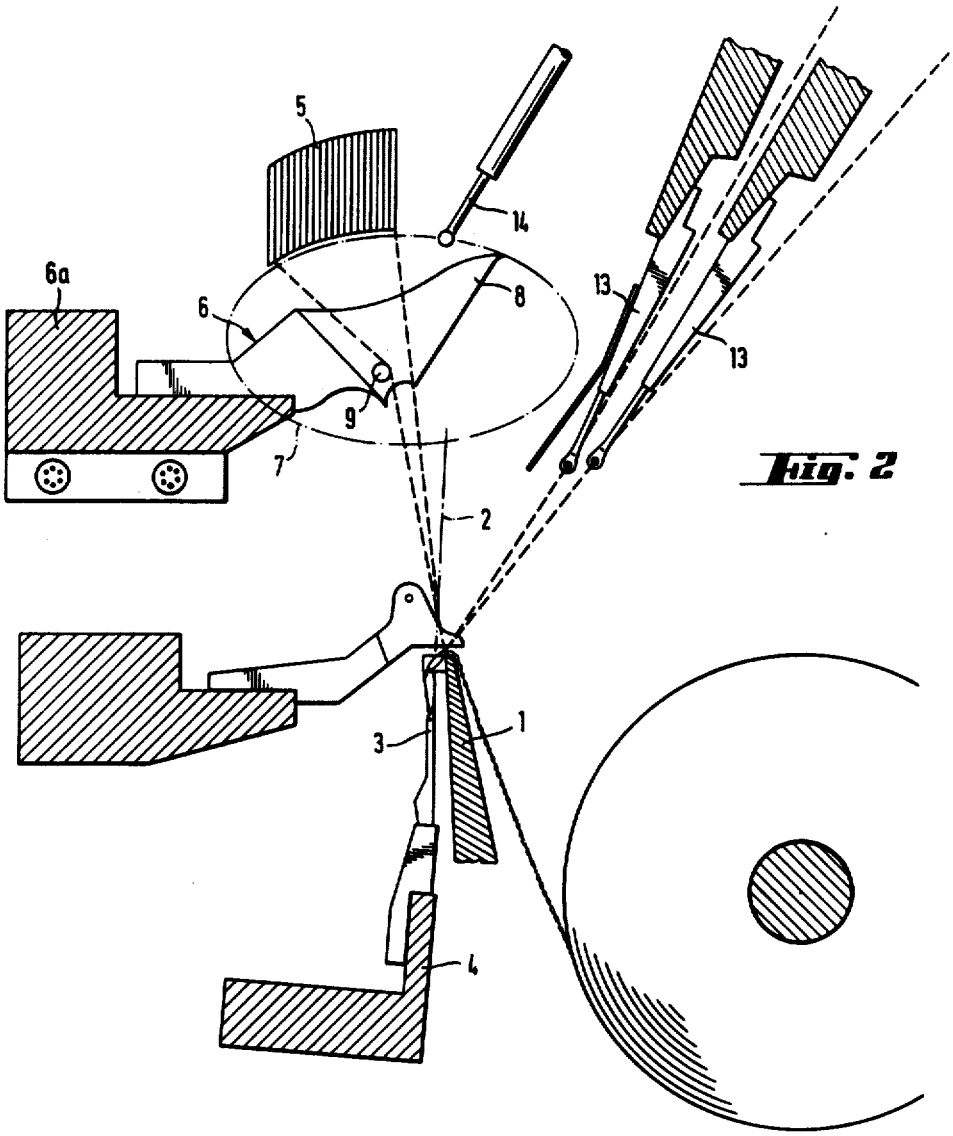
FIG. 2 illustrates a view similar to FIG. 1 with the laying-in comb in a different position from that shown in FIG. 1.

When the comb 6 is in the position shown in FIG. 1, the belts 5 make a shogging and underlapping movement. Thereafter, the comb 6 penetrates the plane of the pattern yarns and moves simultaneously over a fixed shogging length into the position shown in FIG. 2.

During this time, the comb 6 moves at an angle to the plane of drawing.

Referring to FIG. 3, the Raschel machine has a frame 21 on which a plurality of beams 22 are mounted for the pattern yarns and in which a shaft 23 is driven off a main shaft (not shown) of the machine via a bevel gear (not shown). The shaft 23 is connected via suitable means for driving the comb for a uniform selectable shogging distance and means for driving the guide bars 13 for a similar uniform selectable distance in the shogging direction. As indicated, one means includes a sprocket wheel 24 which is mounted on the shaft 23 and which is connected via a chain 25 to a sprocket wheel 26 which drives a cam 27. The cam 27, in turn, cooperates with a push rod 28 to drive the bar 6*a* which carries the yarn laying-in comb 6. The rod 28 has suitable ball joints or the like at the ends to permit the shogging motion to be superposed on the oscillating motion of the comb 6.

In similar manner, the second means includes a further sprocket wheel (not shown) which is mounted on the shaft 23 and which, via a chain 33, drives a shaft 34. The shaft 34 carries a cam 29 which, in turn, cooperates with a push rod 30 to drive the guide bars 13. As shown, the guide bars are mounted on bearing means 31 in holders 32 fixed to the frame 21 so that the guide bars 13 can be shifted and oscillated.

In addition, means 35 are provided on the opposite sides of the machine as shown in FIG. 3 for selectively shogging the belts 5 (located behind the guide bars 13). This means is known and need not be further described.

The invention thus provides a Raschel machine in which a motion parallel to the shogging direction of the lapping belts can be superposed on the laying-in comb and guide bars for the stitch yarns so as to increase the range of variance of a pattern. Instead of guide bars 13, it is possible to use guide belts.

Further, the machine can be programmed so as to carry out a wide range of motions. For example, in the event of an underlapping of the lapping belts 5 with a shogging length, according to the pattern, equal to the fixed shogging distance of the laying-in comb 6, the corresponding belts 5 remain motionless.

In the event of an underlapping of the lapping belts having a shogging length according to the pattern which is less than the fixed shogging length of the comb 6, the corresponding lapping belts are driven in the opposite direction to the fixed shogging length over a correspondingly shorter shogging distance.

If no lapping is to occur according to the pattern, the corresponding lapping belts are driven in the opposite direction to the fixed shogging length of the comb 6 over a distance equal to the fixed shogging length.

What is claimed is:

1. A Raschel warp knitting machine comprising a plurality of needles;

a plurality of parallel lapping belts for guiding pattern yarns to said needles;

first means for selectively shogging said belts in a shogging direction parallel to said belts;

a yarn laying-in comb for laying the pattern yarns into said needles, and comb being mounted for orbital motion perpendicular to said shogging direction;

at least one guide bar having needle guides for guiding stitch yarns to said needles, said guide bar being mounted for oscillation perpendicular to said shogging direction;

and means for driving said comb for a uniform selectable shogging distance in said shogging direction.

2. A machine as set forth in claim 1 which further comprises a second means for driving said guide bar for a uniform selectable distance in said shogging direction.

3. A machine as set forth in claim 2 which includes a shaft for driving said first means and said second means in synchronized relation.

4. A machine as set forth in claim 1 which further comprises a plurality of said guide bars.

* * * * *